US008342665B2

(12) United States Patent
Wu

(10) Patent No.: US 8,342,665 B2
(45) Date of Patent: Jan. 1, 2013

(54) PROTECTOR FOR PRINT HEAD CHIP AND INK CARTRIDGE USED BY THE SAME

(75) Inventor: Junzhong Wu, Guangdong (CN)

(73) Assignee: Zhuhai Ninestar Management Co., Ltd., Guangdong (CN)

( * ) Notice: Subject to any disclaimer, the term of this patent is extended or adjusted under 35 U.S.C. 154(b) by 198 days.

(21) Appl. No.: 12/821,907

(22) Filed: Jun. 23, 2010

(65) Prior Publication Data

US 2010/0259579 A1 Oct. 14, 2010

Related U.S. Application Data

(63) Continuation of application No. PCT/CN2009/070141, filed on Jan. 14, 2009.

(30) Foreign Application Priority Data

Jan. 15, 2008 (CN) ..... 2008 1 0025860

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS

| | | | | |
|---|---|---|---|---|
| 5,850,238 | A | 12/1998 | Karita et al. | 347/29 |
| 5,971,525 | A | 10/1999 | Inoue et al. | 347/50 |
| 6,502,917 | B1 | 1/2003 | Shinada et al. | 347/19 |
| 6,771,378 | B2 * | 8/2004 | Akiyama et al. | 358/1.14 |

FOREIGN PATENT DOCUMENTS

| | | |
|---|---|---|
| CN | 2763042 | 3/2006 |
| CN | 2931121 | 8/2007 |
| CN | 101117054 | 2/2008 |
| CN | 101195302 | 6/2008 |
| CN | 201092146 | 7/2008 |
| CN | 201092146 Y | 7/2008 |
| CN | 201161472 | 12/2008 |
| EP | 0 861 732 | 9/1998 |
| EP | 1145860 | 10/2001 |

(Continued)

OTHER PUBLICATIONS

Translation of CN 201092146 Y.*

(Continued)

*Primary Examiner* — Matthew Luu
*Assistant Examiner* — Justin Seo
(74) *Attorney, Agent, or Firm* — J.C. Patents

(57) ABSTRACT

A protector for a print head chip and an ink cartridge used by the same are provided. The protector (1, 8) for a print head chip is independent from an ink cartridge (9) for storing ink. A contact surface (3) of the protector for a print head chip facing a print head contact is provided with contacts (6) for contacting corresponding contacts of the print head chip. The contact is connected to a memory (5) and sealed between the contacts of the print head chip and the protector for a print head chip. The protector has no structural relation to the ink cartridge, especially an ink supply port (11) and an ink supply needle of the ink cartridge. Therefore, even if the ink cartridge oscillates or moves horizontally to deviate from a centerline of the ink supply port, a communication effect is not influenced.

21 Claims, 8 Drawing Sheets

FOREIGN PATENT DOCUMENTS

| | | | |
|---|---|---|---|
| EP | 1 547 783 | | 6/2005 |
| GB | 2 424 623 | | 10/2006 |
| JP | 2002-513340 | A | 5/2002 |
| JP | 2003-131859 | A | 5/2003 |
| JP | 2003-300359 | A | 10/2003 |
| JP | 2004-174832 | A | 6/2004 |
| JP | 2005-111790 | A | 4/2005 |
| JP | 2006-315302 | A | 11/2006 |

OTHER PUBLICATIONS

Translation of CN 201161472 Y.*

Translation of CN 101195302 A.*

Translation of EP 1854632.*

Translation of JP 2005-111790 A.*

Translation of Japanese office action, dated Jul. 5, 2011, for 2010-540023.*

International Search Report of International Application No. PCT/CN2009/070141, dated Jan. 14, 2009.

Supplementary European Search Report of European Application No. 09 07 4926.6, dated Dec. 7, 2010.

* cited by examiner

PROTECTOR FOR PRINT HEAD CHIP AND INK CARTRIDGE USED BY THE SAME

CROSS-REFERENCE TO RELATED APPLICATIONS

This application is a continuation of International Application No. PCT/CN2009/070141, filed on Jan. 14, 2009, which claims the priority of Chinese Patent Application No. 200810025860.5, filed on Jan. 15, 2008. The contents of the above identified applications are incorporated herein by reference in their entirety.

FIELD OF THE TECHNOLOGY

The present invention relates to a protector for a print head chip of an inkjet printer, an ink cartridge used by the same, and a control method of the print head chip of the inkjet printer.

BACKGROUND

In the prior art, an inkjet printer using a contact chip generally uses a detachable ink cartridge matched with the inkjet printer. Such detachable ink cartridge generally has contacts disposed at bottom or side walls and corresponding to chip contacts disposed at the print head and has a data storage apparatus. The detachable ink cartridge is discarded after use. In order to prevent poor contact or unintended disconnection between the contacts on the detachable ink cartridge and the contacts on the print head, contacts on chip circuit of the detachable ink cartridge are generally arranged to be symmetric to the center of the horizontal oscillation of the ink cartridge in the prior art, so as to minimize displacement of contacts relative to a centerline of the ink supply port, and ultimately prevent the chip from being out of contact. At the same time, in order to prevent poor contact of the chip, a method of disposing or coating a conductive material with good conductivity on the chip contacts is widely adopted in the prior art.

In the above prior art, U.S. Pat. No. 6,502,917 relates to typical disposing locations of chip contacts, the ink cartridge claimed in this patent and the circuit board containing chip contacts are not separable, and the ink cartridge with the chip contacts is discarded after use with a large amount of ink remaining therein. Because a position relation of the chip contacts and a centerline of an ink supply port must be satisfied, integral injection molding of the ink cartridge and installation of the chip need to maintain high accuracy in this patent. At the same time, in order to ensure firmness of chip positioning, in U.S. Pat. No. 7,008,053, an elastic handle is further proposed. The elastic handle is disposed on a sidewall of an ink cartridge opposite to a chip, and the chip is even disposed on a protruding orientation apparatus.

In order to prevent the chip from being damaged when the whole ink cartridge where the chip is located drops down or is impacted, a protruding protection apparatus is further used in U.S. Pat. No. 6,550,902, that is, an overhanging member is disposed above a circuit where a chip is located. Such the overhanging member is also used in a circuit board where the ink cartridge is located previously. However, a protection effect of the overhanging member is very limited, when the whole ink cartridge drops down, even if a surface of the ink cartridge where the circuit board is located is not directly impacted or collided, an impact stress is large enough to damage a chip or a circuit inside the chip with very low intensity, leaving the whole ink cartridge useless.

The inventor of the present invention noted that the chip and the memory used in the prior art do not physically detect and record ink in the ink cartridge, but assume that a certain amount of ink has been injected into the ink cartridge through settings of a program. Even if the ink cartridge still has a large amount of ink remaining, a detecting device may still prompt that the ink is exhausted or the ink cartridge needs to be replaced, while the amount of the remaining ink can be upto 30%.

The inventor of the present invention noted that the chip and the memory used in the prior art are integrally disposed on a wall of the ink cartridge. When the ink cartridge is discarded, the chip, the memory and the residual ink are discarded together. Therefore, not only electronic waste is produced, but also chemical waste is produced.

The inventor of the present invention noted that the chip and the memory used in the prior art are integrally disposed on a wall of the ink cartridge. Such a design inevitably results in friction between the chip contacts on the ink cartridge and the chip contacts on the print head. The friction exists both during replacement process of the ink cartridge and during printing process of the printer.

The technical solutions in the prior art have the following common problems: the ink cartridge is for one-time use and a large amount of ink remains after the ink cartridge is discarded, thus indubitably causing environment pollution. The chip contacts on the print head are subjected to wear caused by multiple installation and replacement of the ink cartridge and use processes, so that the working life of the printer, especially the working life of the print head is affected. At the same time, a consumer has to spend a lot of money each time to buy an ink cartridge and a chip attached on the ink cartridge merely accomplishing a virtual detection function in fact. Furthermore, the structure of an ink cartridge in the prior art is too complicated.

SUMMARY

The present invention is directed to a protector for a print head chip, which has a simple structure, is convenient for assembly and replacement, is capable of accurate positioning, and facilitates to protect contacts of the print head chip and a memory connected thereto, and an ink cartridge used by the same.

The present invention is further directed to a protector for a print head chip, which makes it possible to preserve the chip and the memory connected thereto that, in the prior art, must be discarded after use, and they can be reused after reset.

The present invention is further directed to a protector for a print head chip capable of being reset, such that the problem of ink residue in the prior art is solved, and the ink in the ink container can be fully utilized and the residue is greatly reduced through specific arrangement of an ink supply port and a reset printing function.

The objectives of the present invention are realized by employing the following technical solutions.

The present invention provides a protector for a print head chip, which is independent from an ink cartridge for storing ink. A contact surface of the protector for the print head chip and the ink cartridge facing a print head contact is provided with contacts for contacting corresponding contacts of the print head chip. The contacts are connected to a memory and sealed between the contacts of the print head chip and the protector for the print head chip. The protector for the print head chip is positioned and firmly installed on the print head.

The protector for the print head chip is provided with a positioning device or a positioning hole for matching the print head.

According to the present invention, the protector for the print head chip is provided with a reset device for the memory.

According to the present invention, the memory is sealed between the contacts of the print head chip and the protector for the print head chip or located in a chamber at an end where a chip of the protector for the print head chip is located.

According to the present invention, the reset device of the memory is connected to a control button of the printer or disposed independently.

According to the present invention, the memory is connected to a reset device, and the reset device includes:

a main control circuit, adapted to rewrite information into the memory;

a main control circuit power supply; and an isolation circuit; wherein the above circuits are electrically connected to each other.

According to the present invention, the main control circuit adapted to rewrite the information and the memory are integrally formed or disposed on the same circuit board.

According to the present invention, the ink cartridge filled with ink is independent from the protector for the print head chip. An ink supply needle is inserted in an ink supply port of the ink cartridge. The ink cartridge filled with the ink and the protector for the print head chip have a detachable and slidable matching relation or a detachable fixed connection relation. The ink supply port of the ink cartridge is provided with an elastic sealing device. The elastic sealing device seals the ink supply port and surrounds and clamps the ink supply needle.

According to the present invention, the elastic sealing device is hollow inside. An upper end of the hollow portion of the elastic sealing device is provided with a seal port for sealing the ink supply needle. A bottom of the hollow portion of the elastic sealing device is a sealed end or has a cut for the ink supply needle to pass through. The sealing device is provided with a flange for sealing the ink supply port at the periphery thereof. The flange includes one circle, two circles, or multiple circles.

According to the present invention, the protector for a print head chip is provided with an elastic piece disposed on a sidewall. The ink cartridge filled with the ink elastically contacts the elastic piece of the protector for the print head chip.

The present invention provides a control method of a protector for a print head chip. A printer performs power-on reset and system initialization on a memory of the protector for the print head chip after contacts on a print head are connected to contacts on a protector for a print head chip. If the memory of the protector for the print head chip is powered by the printer, the reset device is in a sleep state. If the memory is powered by a main control circuit power supply, the isolation circuit isolates the printer from the memory, and only the main control circuit is left to operate the memory. The main control circuit determines a value indicating the amount of the ink in the memory. If the value indicating the amount of the ink in the memory reaches a set value, a residual value is set to 0, and the value indicating the amount of the ink in the memory is reset to a full value. If the value indicating the amount of the ink in the memory does not reach the set value, the value indicating the amount of the ink in the memory cannot be reset to a full value, such that the reset device resets only when the amount of the ink in the memory is 0. The reset device cannot reset in other states.

As the present invention adopts the technical solutions described above, various defects existing in the prior art are eliminated and the present invention has the following advantages and positive effects.

The firmly positioned protector for the print head chip may have no structural relation with the independent ink cartridge and the ink supply port and the ink supply needle of the ink cartridge. Therefore, even if the ink cartridge oscillates or moves horizontally to deviate from a centerline of the ink supply port, communication effect is not influenced.

1. The structure of the protector for the print head chip is very simple. Compared to a hollow ink cartridge or a complicated ink cartridge in the prior art, the protector for the print head chip can realize precise injection molding, so as to ensure good corresponding contact of chip contacts.

2. The protector for the print head chip can ensure that both the contacts of the print head chip and the contacts on the protector for the print head chip that contact the contacts of the print head chip are in a firm sealing and contacting state, so that the contacts can not be contaminated or corroded by the ink, and the possibility of being shocked, scrubbed or worn is basically eliminated.

3. As the protector for the print head chip seals the contacts of the print head chip, the contacts on the protector for the print head chip that contact the contacts of the print head chip and the memory thereof, even through the ink cartridge is installed and replaced many times, no damage would occur to the contacts of the print head chip and the contacts on the protector for the print head chip that contact the contacts of the print head chip, so as to facilitate to protect the print head and the printer thereof.

4. As the protector for the print head chip seals the contacts of the print head chip and the contacts on the protector for the print head chip that contact the contacts of the print head chip, so that the protruding protection device need not to be disposed on the circuit board where the chip is located as in the prior art, and the elastic handle neither need not to be disposed for the ink cartridge as in the prior art, such that an overall structure of the ink cartridge is simplified significantly.

5. Even if accidental damages occur to the ink cartridge or the protector for the print head chip, only damaged parts need to be replaced.

Due to the setting of the reset device, the protector for the print head chip can easily reset the memory. Such setting not only facilitates to fully consume the ink, but also helps consumers to continue printing by replacing the ink cartridge only.

6. The protector for the print head chip is installed one time and can be used for a long term and in a recycled mode. That is, the consumers need not to buy a protector for the print head chip every time. Instead, the consumers only need to buy the ink cartridge for replacement, so as to reduce use cost.

7. An elastic piece disposed on a sidewall of the protector for the print head chip can buffer impacts on the protector for the print head chip by the ink cartridge filled with the ink.

8. As the protector for the print head chip seals the contacts of the print head chip, the contacts on the protector for a print head chip that contact the contacts of the print head chip and the memory, even if the ink cartridge is installed and replaced many times, no damage would occur to the memory, and it is the same as the use process, so as to facilitate to protect the print head, the contacts on the protector for the print head chip and the memory, and ensure long-term recycle use.

BRIEF DESCRIPTION OF THE DRAWINGS

The present invention will become more fully understood from the detailed descriptions given herein below, the following embodiments are for illustration only, and thus are not limitative of the present invention.

DETAILED DESCRIPTION

In order to fully understand the present invention, the present invention is further illustrated with reference to the accompanying drawings.

Figure 1:
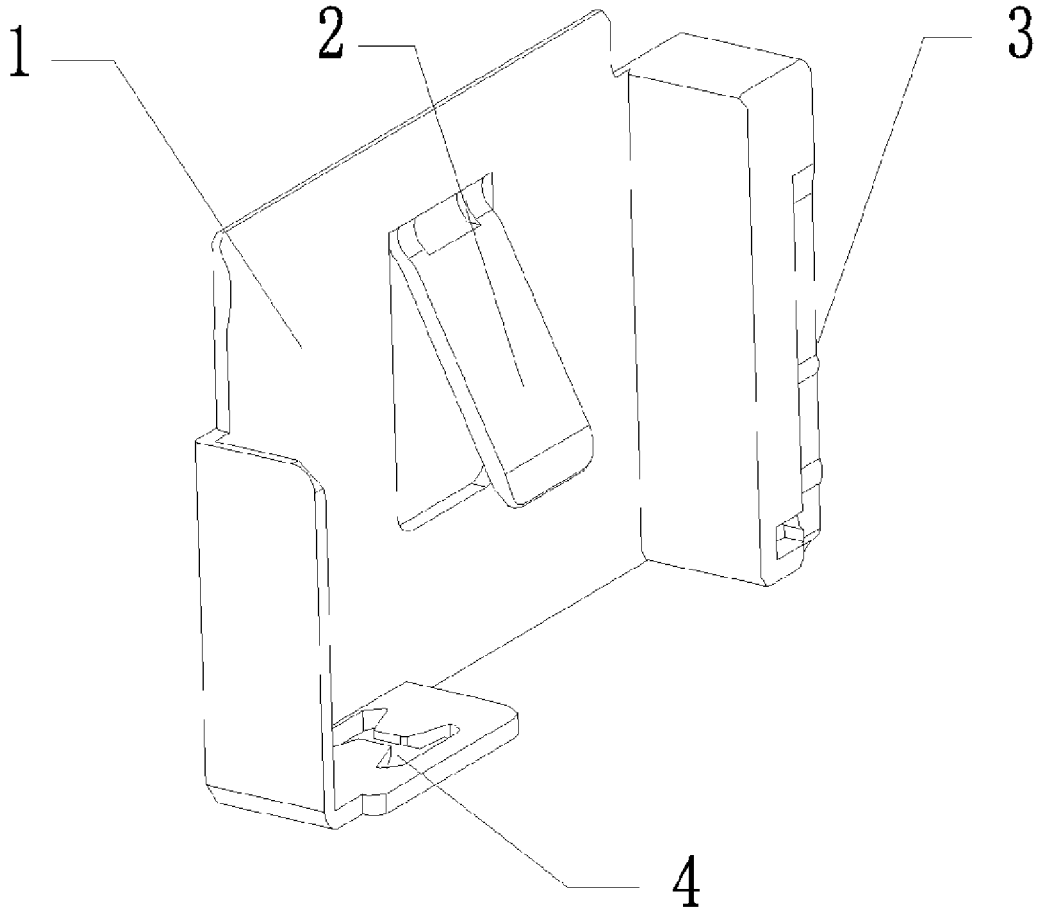
FIG. 1 is a schematic structural view of a protector for a print head chip used in the present invention.

FIG. 1 is a schematic view of the protector of a print head chip used in the present invention. An elastic piece 2 is disposed on a sidewall of a protector 1 for a print head chip. The elastic piece has a buffer effect. The protector 1 for the print head chip is provided with a contact surface 3 facing contacts of the print head on a front portion. Contacts for contacting the corresponding contacts of the print head chip and a memory are disposed on the contact surface 3. A positioning hole 4 matched with the print head is disposed on a bottom of the protector 1 for the print head chip. The positioning hole 4 may position and firmly fix the protector 1 for the print head chip on the print head. The firmly positioned protector 1 for the print head chip has no structural relation with the independent ink cartridge and an ink supply port and an ink supply needle of ink cartridge. Therefore, even if the ink cartridge oscillates or moves horizontally to deviate from a centerline of the ink supply port, a communication effect is not influenced.

Figure 2:
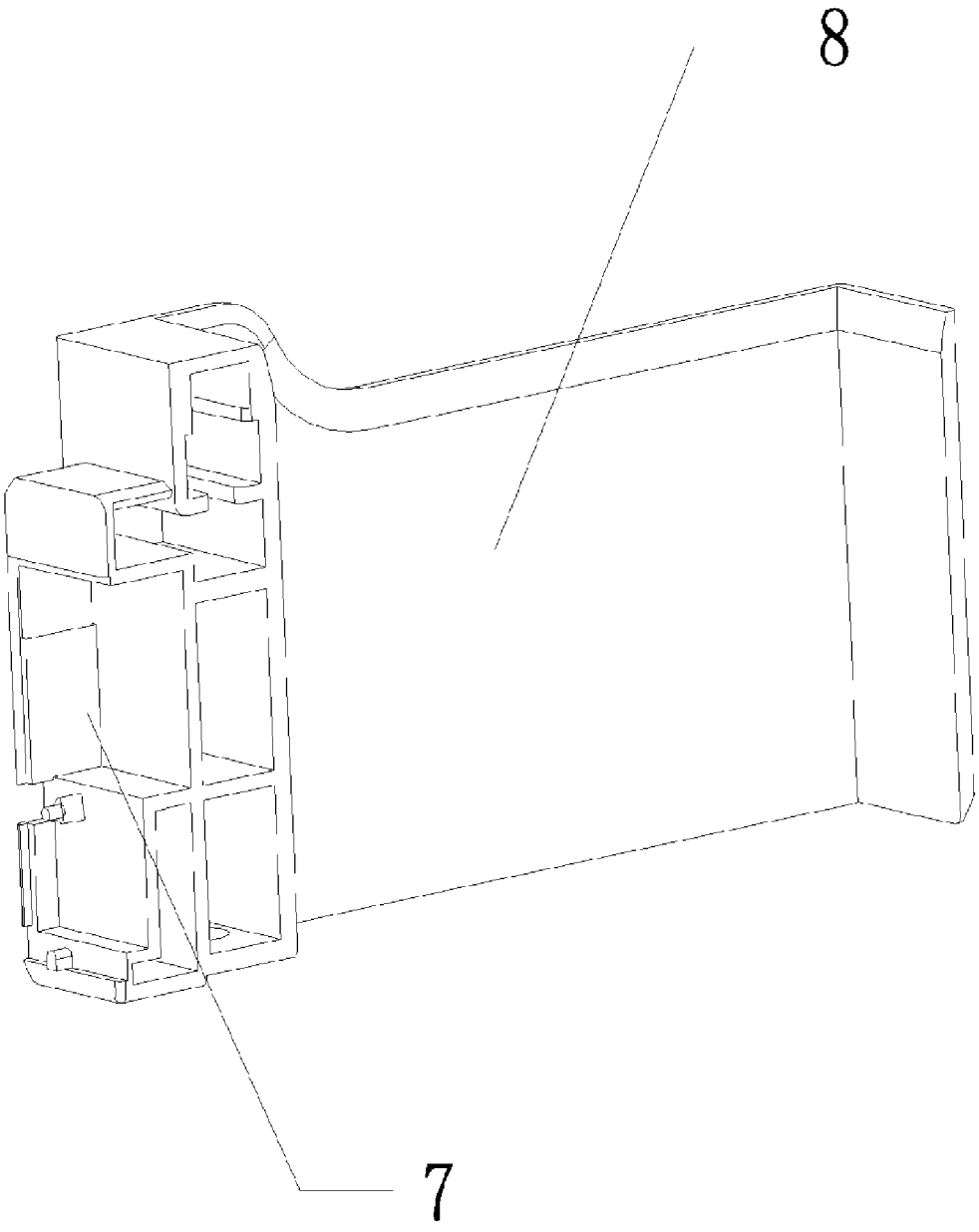
FIG. 2 is a schematic structural view of another protector for a print head chip used in the present invention.

FIG. 2 is a schematic structural view of another protector for the print head chip used in the present invention. A fixing position 7 for installing a memory is provided at a back end of the protector 8 for the print head chip, such that a memory is sealed in the protector for the print head chip and thus be protected. As the protector for the print head chip seals contacts of the print head chip, contacts on the protector for the print head chip that contact the contacts of the print head chip, and the memory, such that even if the ink cartridge is installed and replaced many times, no damage would occur to the contacts of the print head chip and the contacts on the protector for the print head chip that contact the contacts of the print head chip, so as to facilitate to protect the print head and the printer. The structure of the protector for the print head chip is very simple. Compared to the hollow ink cartridge or the complicated ink cartridge in the prior art, the protector for the print head chip can realize precise injection molding and ensure corresponding contact of chip contacts. As the protector for the print head chip seals the contacts of the print head chip and the contacts on the protector for the print head chip and the memory, a protruding protection device need not to be disposed on the circuit board where the chip is located as in the prior art, and an elastic handle need not to be disposed for the ink cartridge as in the prior art, such that the whole structure of the ink cartridge is simplified significantly.

Figure 3A:
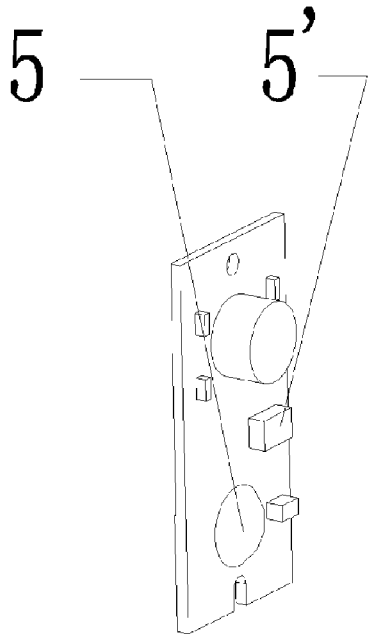
FIG. 3A is a schematic view of positions of a memory and a reset device of a protector for a print head chip.
Figure 3B:
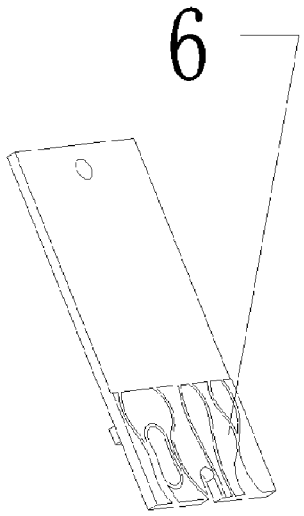
FIG. 3B is a schematic view of positions of contacts on a protector for a print head chip.

FIGS. 3A and 3B are schematic views of the arrangement of a memory 5, a reset device 5', and contacts 6 of the protector for the print head chip on a circuit board. The contacts 6 are disposed on a front side of a circuit board and the memory 5 and the reset device 5' are disposed on a back side of the circuit board. The back side of the circuit board where the memory 5 and the reset device 5' are located is in a chamber, so that the memory 5 and the reset device 5' can be protected. Even if accidental damages occur to the ink cartridge or the protector for the print head chip, only the damaged part needs to be replaced.

Figure 4:
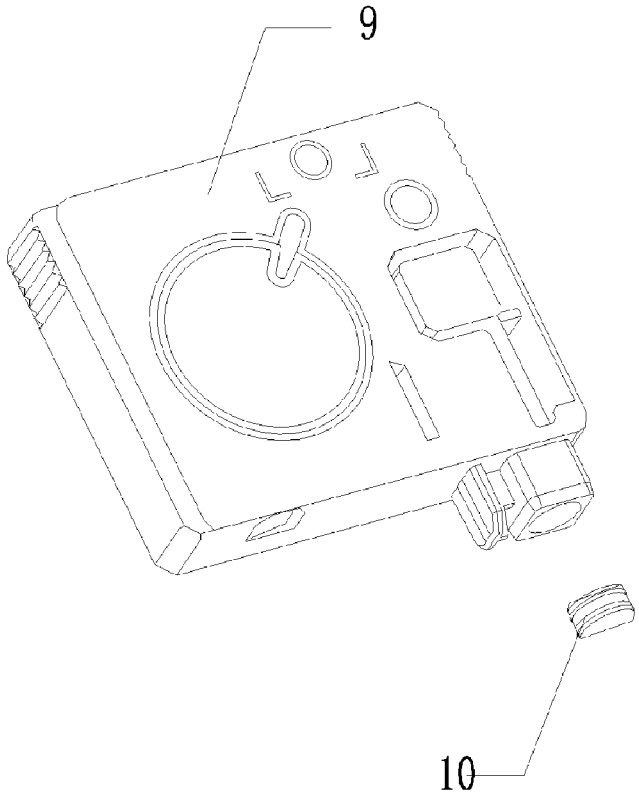
FIG. 4 is a schematic view of an isolation state of an ink cartridge and a seal component according to the present invention.
Figure 5:
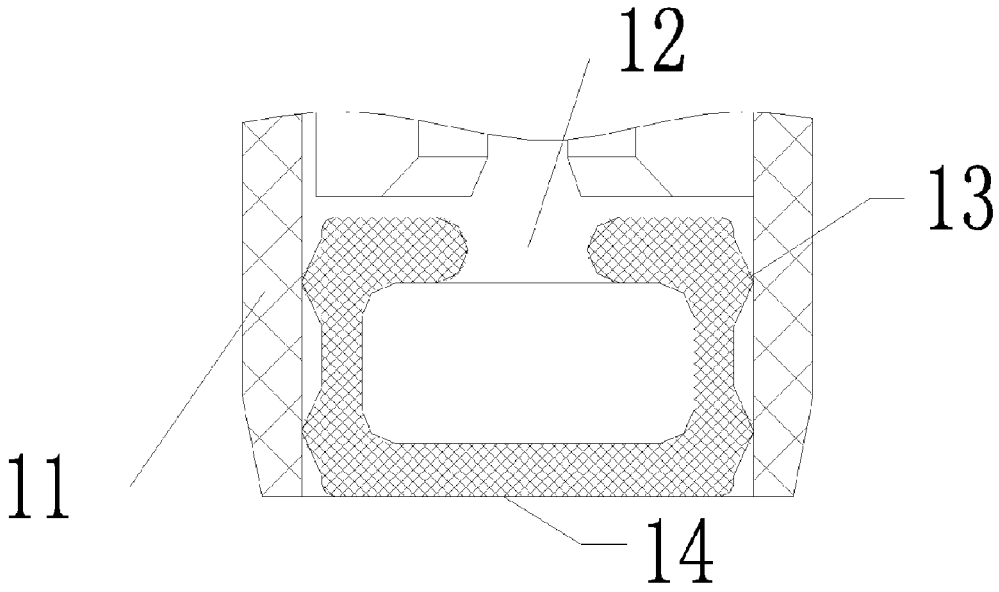
FIG. 5 is a schematic structural view of a seal component of an ink supply port of an ink cartridge according to the present invention.

FIGS. 4 and 5 show an ink cartridge 9 and a seal component 10. The ink cartridge 9 and the protector for the print head chip have a smooth and detachable matching relation. The seal component 10 is disposed at an ink supply port 11 of the ink cartridge 9. The seal component 10 is made of elastic material and has an approximately cylindrical or round table-like appearance. The seal component 10 is hollow inside, has a seal port 12 at one end thereof adapted to seal the ink supply needle on the print head. The seal port 12 of the seal component surrounds and clamps the ink supply needle firmly, thus realizing positioning of the ink cartridge. A flange 13 is disposed at the periphery of the seal component 10. The flange 13 may include one circle, two circles or multiple circles and is used to seal the ink supply port 11 of the ink cartridge 9. The other end 14 of the seal component 10 is a sealed end or has a cut formed in advance. When the ink cartridge is detached from the print head, the sealed end 14 of the seal component 10 is closed automatically, so as to prevent leakage of the ink.

Of course, the ink cartridge 9 and the protector for the print head chip may also have a detachable fixed connection relation. However, in this case, the ink cartridge 9 and the protector for the print head chip easily oscillate with the printer integrally. Therefore, the protector for the print head chip needs to be positioned on the print head firmly through precise injection molding of the protector for the print head chip and selection of elastic plastic.

Figure 6:
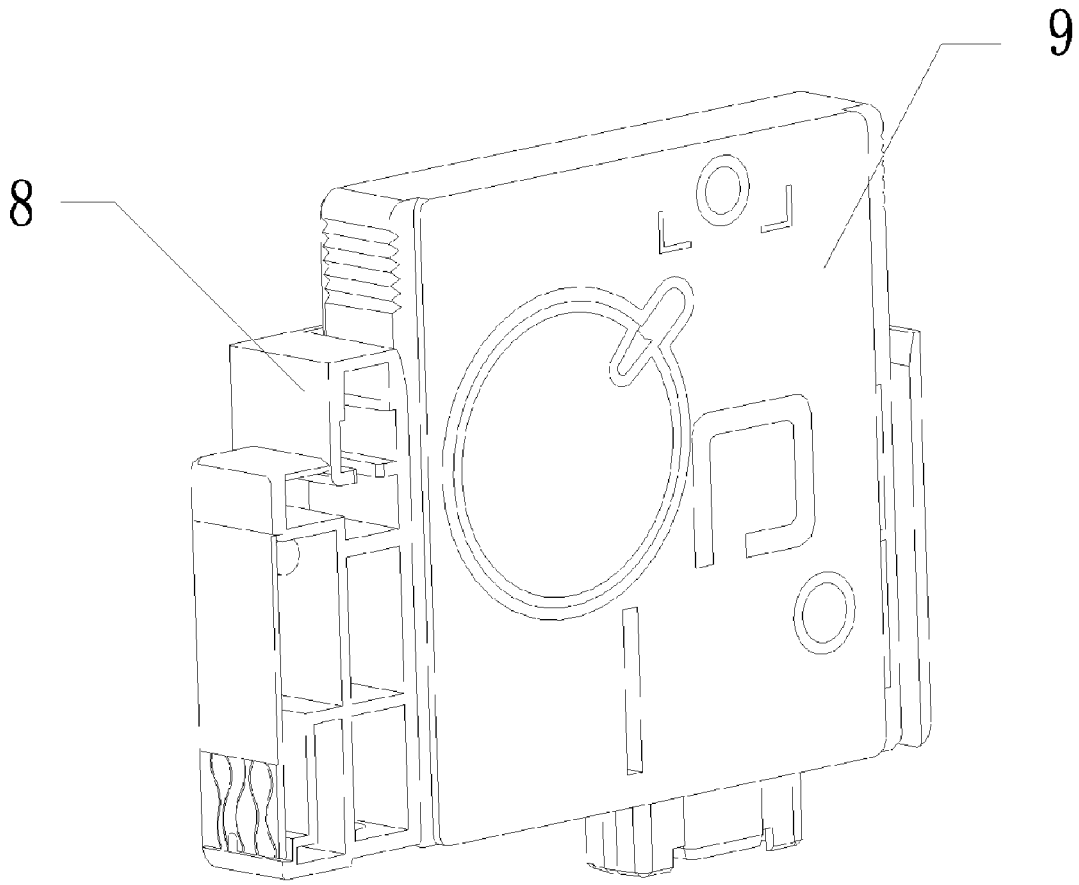
FIG. 6 is a schematic view of an installation and use state of the ink cartridge according to the present invention.

FIG. 6 is a schematic view of the installation and use state of the ink cartridge according to the present invention. The use state is a use state on the print head. The ink cartridge and the protector for the print head chip are not installed on the print head yet, they cannot be installed together, as they do not have any matching relation. The firmly positioned protector for the print head chip does not have any structural relation with the independent ink cartridge and the ink supply port and the ink supply needle of the ink cartridge. Therefore, even if the ink cartridge oscillates or moves horizontally to deviate from the centerline of the ink supply port, the communication effect will not be influenced.

Figure 7:
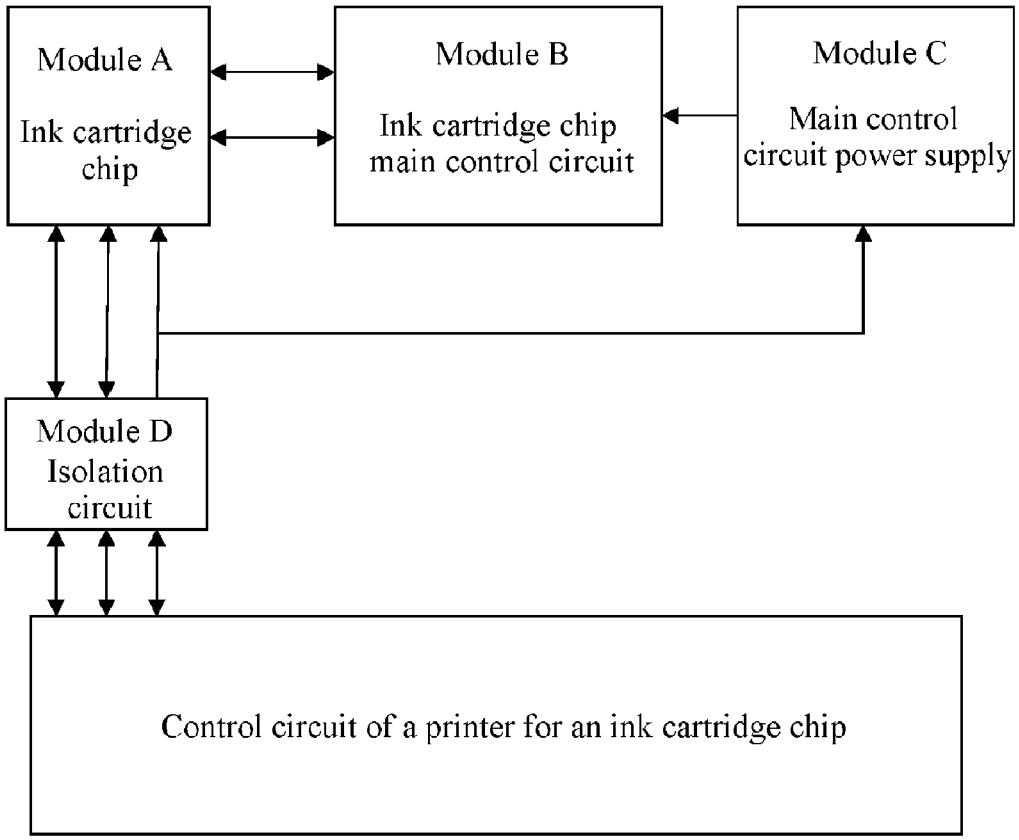
FIG. 7 is a block diagram of a control principle of the present invention.

FIG. 7 is a block diagram of the control principle of the reset device. A control circuit includes four parts. A module A is the memory of the protector for the print head chip, which records corresponding information of the ink cartridge. A module B is a main control circuit, that is, a reset functional circuit, which resets ink amount information on the memory when the ink cartridge is replaced after the ink in the ink cartridge is exhausted. A module C is a main control circuit power supply, which provides power supply for the main control circuit of the memory. A module D is an isolation circuit, which isolates connection between the printer and the memory when the main control circuit resets the memory.

Figure 8:
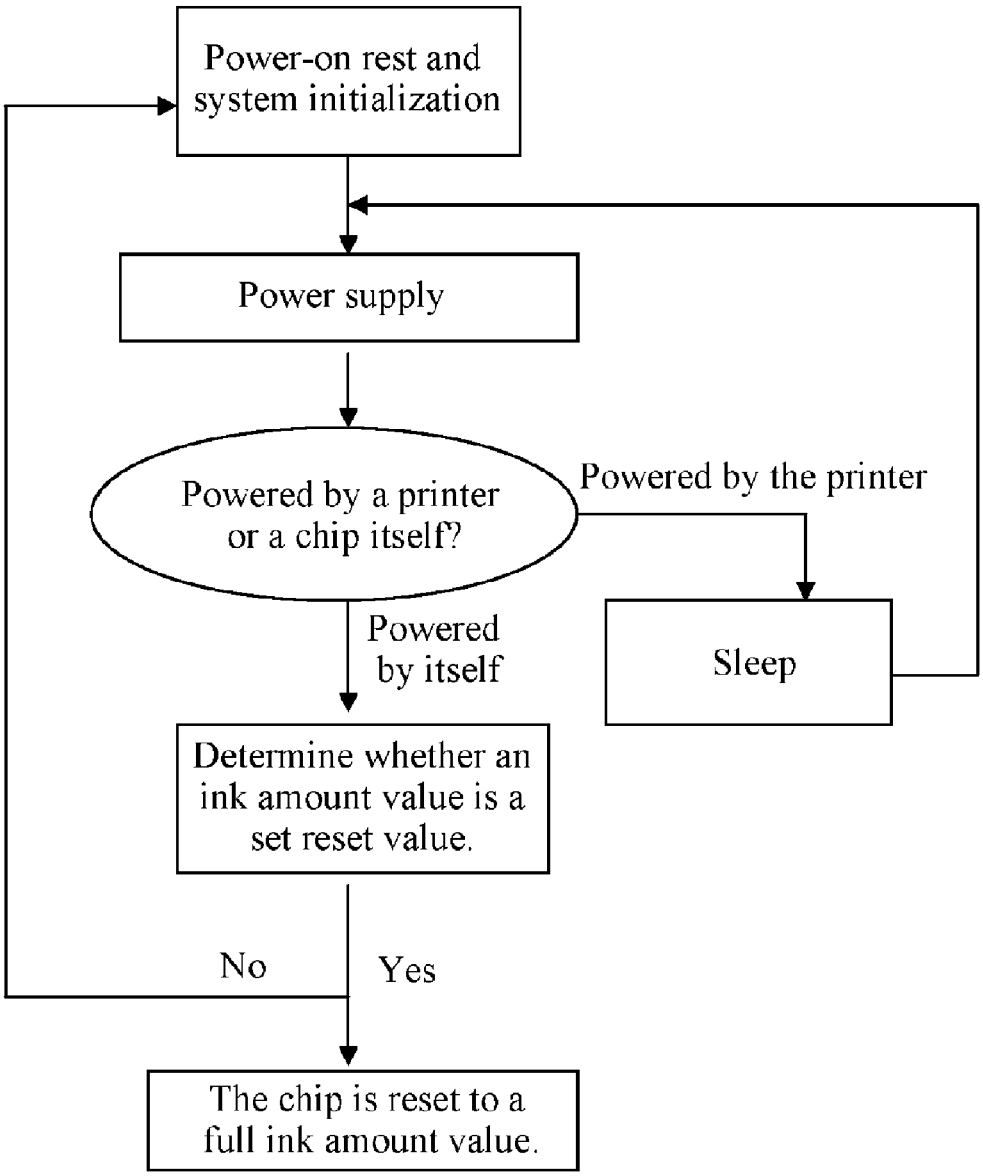
FIG. 8 is a flow chart of a control procedure according to the present invention.
Figure 9:
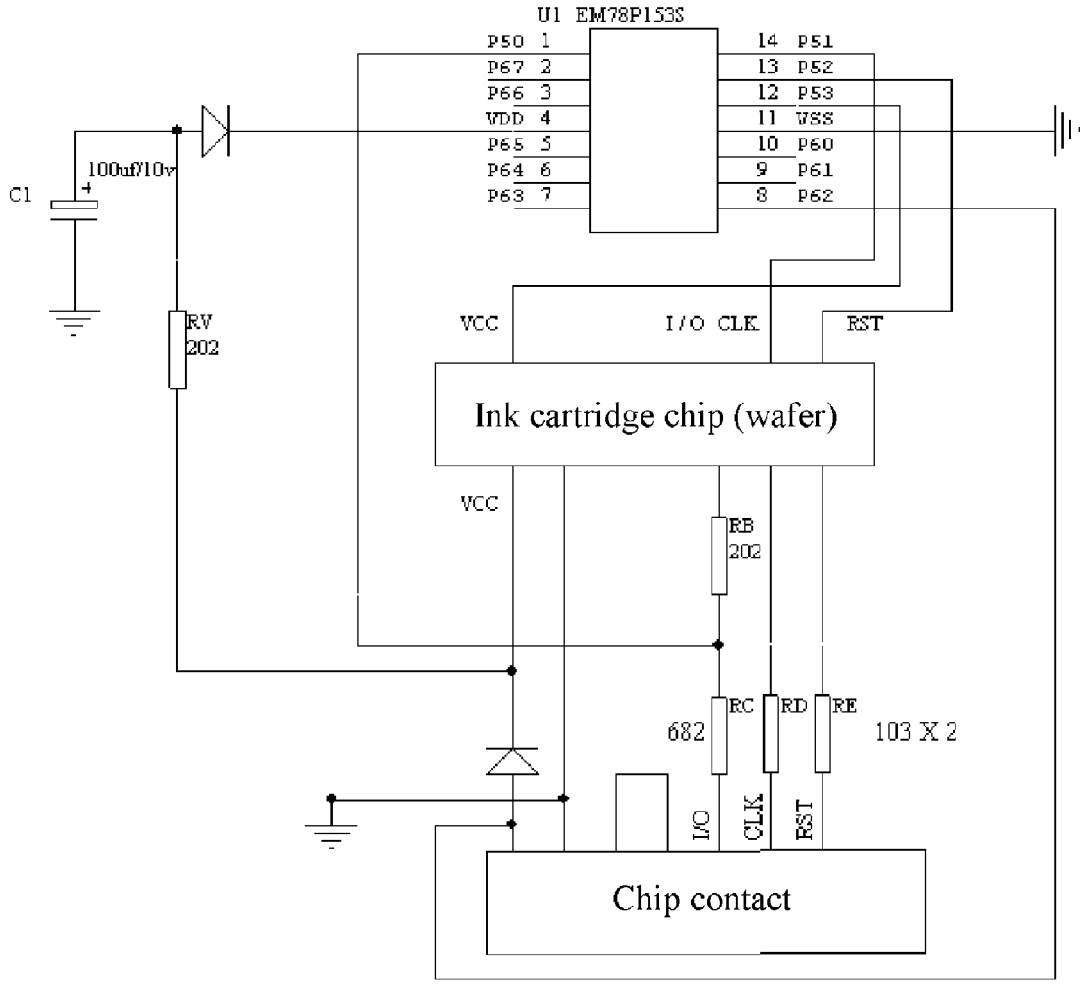
FIG. 9 is a detailed circuit diagram suitable for the control principle selected according to the present invention.

FIG. 8 is a flow chart of a control procedure of the reset device. FIG. 9 is a detailed circuit diagram suitable for the control principle selected according to the present invention. During use, when the protector for the print head chip needs to be installed on the print head of the printer, the positioning hole of the protector for the print head chip and the print head are firmly positioned, and then the ink cartridge is installed into the protector for the print head chip. When the contacts of the print head are connected to the contacts on the protector for the print head chip, the printer performs power-on reset and system initialization on the memory of the protector for the print head chip. If the memory of the protector for the print head chip is powered by the printer, the reset device is in a sleep state and does not act. If the memory is powered by the main control circuit power supply, the isolation circuit isolates the printer from the memory, and only the main control circuit is left to operate the memory. The main control circuit determines a value indicating the amount of ink in the memory. If the value indicating the amount of the ink in the memory reaches a set value, a residual value is set to 0, and the value indicating the amount of the ink in the memory is reset to a full value. If the value indicating the amount of the ink in the memory does not reach the set value, the value indicating the amount of the ink in the memory cannot be reset to a full value, such that the reset device resets only when the amount of the ink in the memory is 0. The reset device cannot reset in other state. Due to the settings of the reset device, the protector for the print head chip can easily reset the memory. Such settings not only facilitate full consumption of the ink, but also help consumers to continue printing by only replacing the ink cartridge. The protector for the print head chip is installed one time but can be used for a long term and in a recycled mode. That is, the consumers need not to buy the protector for the print head chip every time and instead only needs to buy the ink cartridge for replacement, so as to reduce use cost. As the protector for the print head chip seals the contacts of the print head chip, the contacts on the protector for the print head chip that contact the contacts of the print head chip and the memory, even if the ink cartridge is installed and replaced many times, no damage would occur to the memory, and it is also the same during use, so as to facilitate to protect the print head, the contacts on the protector for the print head chip and the memory, and ensure long-term recycle use.

What is claimed is:

1. A protector for a print head chip of a printer, independent from an ink cartridge for storing ink, wherein a contact surface of the protector for the print head chip facing contacts of the print head chip is provided with contacts for contacting corresponding contacts of the print head chip, the contacts of the protector are disposed on a circuit board of the protector, connected to a memory disposed on the protector and sealed in a space between the contacts of the print head chip and the protector for the print head chip, and the protector for the print head chip is positioned and firmly fixed on a print head.

2. The protector for the print head chip according to claim 1, wherein the protector for the print head chip is provided with a reset device for the memory.

3. The protector for the print head chip according to claim 2, wherein the memory is sealed between the contacts of the print head chip and the protector for the print head chip or located in a chamber on a side where the circuit board of the protector for the print head chip is located.

4. The protector for the print head chip according to claim 2, wherein the reset device is connected to a control button of a printer or is disposed independently from the control button.

5. The protector for the print head chip according to claim 1, wherein the memory is connected to a reset device, and the reset device comprises:

a main control circuit, adapted to rewrite information into the memory;

a main control circuit power supply; and an isolation circuit, wherein the above circuits are electrically connected to each other.

6. The protector for the print head chip according to claim 2, wherein the memory is connected to the reset device, and the reset device comprises:

a main control circuit, adapted to rewrite information into the memory;

a main control circuit power supply; and an isolation circuit, wherein the above circuits are electrically connected to each other.

7. The protector for the print head chip according to claim 3, wherein the memory is connected to a reset device, and the reset device comprises:

a main control circuit, adapted to rewrite information into the memory;

a main control circuit power supply; and an isolation circuit, wherein the above circuits are electrically connected to each other.

8. The protector for the print head chip according to claim 4, wherein the memory is connected to the reset device, and the reset device comprises:

a main control circuit, adapted to rewrite information into the memory;

a main control circuit power supply; and an isolation circuit, wherein the above circuits are electrically connected to each other.

9. The protector for the print head chip according to claim 5, wherein the main control circuit adapted to rewrite the information and the memory are integrally formed, or disposed on the circuit board.

10. The protector for the print head chip according to claim 6, wherein the main control circuit adapted to rewrite the information and the memory are integrally formed, or disposed on the circuit board.

11. The protector for the print head chip according to claim 7, wherein the main control circuit adapted to rewrite the information and the memory are integrally formed, or disposed on the circuit board.

12. The protector for the print head chip according to claim 8, wherein the main control circuit adapted to rewrite the information and the memory are integrally formed, or disposed on the circuit board.

13. The protector for the print head chip according to claim 1, wherein the ink cartridge filled with ink is independent from the protector for the print head chip, an ink supply needle is inserted in an ink supply port of the ink cartridge, the ink cartridge filled with the ink and the protector for the print head chip have a detachable and slidable matching relation or a detachable fixed connection relation, an elastic sealing device is disposed at the ink supply port of the ink cartridge, and the elastic sealing device seals the ink supply port and surrounds and clamps the ink supply needle.

14. The protector for the print head chip according to claim 13, wherein the elastic sealing device is hollow inside, an upper end of a hollow portion of the elastic sealing device is provided with a seal port for sealing the ink supply needle, a bottom of the hollow portion of the elastic sealing device is a sealed end or is provided with a cut for the ink supply needle to pass through, the sealing device is provided with a flange for sealing the ink supply port at the periphery thereof, and the flange includes one circle, two circles, or multiple circles.

15. The protector for the print head chip according to claim 5, wherein the ink cartridge filled with the ink is independent from the protector for the print head chip, an ink supply needle is inserted in the ink supply port, the ink cartridge filled with the ink and the protector for a print head chip have a detachable and slidable matching relation or a detachable fixed connection relation, the ink supply port of the ink cartridge is provided with a elastic sealing device, and the elastic sealing device seals the ink supply port and surrounds and clamps the ink supply needle.

16. The protector for the print head chip according to claim 6, wherein the ink cartridge filled with the ink is independent from the protector for the print head chip, an ink supply needle is inserted in the ink supply port, the ink cartridge filled with the ink and the protector for a print head chip have a detachable and slidable matching relation or a detachable fixed connection relation, the ink supply port of the ink cartridge is provided with a elastic sealing device, and the elastic sealing device seals the ink supply port and surrounds and clamps the ink supply needle.

17. The protector for the print head chip according to claim 7, wherein the ink cartridge filled with the ink is independent from the protector for the print head chip, an ink supply needle is inserted in the ink supply port, the ink cartridge filled with the ink and the protector for a print head chip have a detachable and slidable matching relation or a detachable fixed connection relation, the ink supply port of the ink cartridge is provided with a elastic sealing device, and the elastic sealing device seals the ink supply port and surrounds and clamps the ink supply needle.

18. The protector for the print head chip according to claim 8, wherein the ink cartridge filled with the ink is independent from the protector for the print head chip, an ink supply needle is inserted in the ink supply port, the ink cartridge filled with the ink and the protector for a print head chip have a detachable and slidable matching relation or a detachable fixed connection relation, the ink supply port of the ink cartridge is provided with a elastic sealing device, and the elastic sealing device seals the ink supply port and surrounds and clamps the ink supply needle.

19. The protector for the print head chip according to claim 15, wherein an elastic piece is disposed on a sidewall of the protector for a print head chip, and the ink cartridge filled with the ink elastically contacts the elastic piece of the protector for the print head chip.

20. The protector for the print head chip according to claim 1, wherein the memory is disposed on the circuit board of the protector.

21. The protector for the print head chip according to claim 1, wherein a positioning hole matched with the print head is disposed on a bottom of the protector so as to position and firmly fix the protector for the print head chip on the print head.

* * * * *